US006915949B1

(12) United States Patent
Economopoulos

(10) Patent No.: US 6,915,949 B1
(45) Date of Patent: Jul. 12, 2005

(54) MULTI-LAYERED PIZZA PIE BOX

(76) Inventor: Demosthenes O. Economopoulos, 22201 Benjamin, St. Clair Shores, MI (US) 48081

( * ) Notice: Subject to any disclaimer, the term of this patent is extended or adjusted under 35 U.S.C. 154(b) by 0 days.

(21) Appl. No.: 10/428,364

(22) Filed: May 2, 2003

(51) Int. Cl.[7] ..... B65D 25/04
(52) U.S. Cl. ..... 229/120.32; 229/120.33; 229/120.34; 229/906; 229/903
(58) Field of Search ..... 229/120.32, 120.33, 229/120.34, 906, 903

(56) References Cited

U.S. PATENT DOCUMENTS

| | | | | |
|---|---|---|---|---|
| 2,732,121 A | | 1/1956 | McGovern | |
| 2,758,774 A | * | 8/1956 | Grunert et al. | 229/117.07 |
| 2,926,831 A | * | 3/1960 | Strange | 229/117.03 |
| 3,013,710 A | | 12/1961 | Kronson et al. | |
| 3,656,611 A | * | 4/1972 | Mertz | 206/764 |
| 4,356,953 A | | 11/1982 | Rekow | |
| 4,739,921 A | | 4/1988 | Taub | |
| 4,944,452 A | * | 7/1990 | Kent et al. | 229/120.21 |
| 4,957,237 A | * | 9/1990 | Madonna et al. | 229/120 |
| 5,002,221 A | * | 3/1991 | Ragan | 229/120 |
| 5,049,710 A | * | 9/1991 | Prosise et al. | 219/730 |
| 5,273,206 A | * | 12/1993 | Vassiliou | 229/117.01 |
| 5,351,880 A | | 10/1994 | Goudreau | |
| 5,445,314 A | * | 8/1995 | Newsome | 229/120.21 |
| D362,803 S | | 10/1995 | McMullen, Jr. | |
| 5,544,806 A | | 8/1996 | Anderson | |
| 5,950,912 A | * | 9/1999 | Economopoulos | 229/120.32 |
| 6,386,440 B1 | * | 5/2002 | Tulkoff | 229/120.32 |

OTHER PUBLICATIONS

Definition of "adjacent" from thefreedictionary.com.*

* cited by examiner

*Primary Examiner*—Tri M. Mai
(74) *Attorney, Agent, or Firm*—Young & Basile, P.C.

(57) ABSTRACT

A rectangular box for transporting multiple pizza pies in a stacked formation formed by a single cardboard blank having scoring and cut-outs for assembling into a multiple pizza box. The box has a bottom wall, four side walls and a lid hinged to one of the side walls. When assembled the box has a pair of corner shelf supports and a removable shelf for positioning a second pizza pie. The shelf supports also provide a stop for the lid of the box to prevent crushing the contents. Both the rectangular box and a removable shelf can be stored flat when not in use.

17 Claims, 4 Drawing Sheets

MULTI-LAYERED PIZZA PIE BOX

FIELD OF THE INVENTION

The present invention relates to an improved multi-layered pizza box.

BACKGROUND OF THE INVENTION

It is common for customers to order carry-out pizza pies or to order delivery of the pizza pies. Many times the customers will order two or more pizza pies having different toppings to accommodate the different tastes of their guests or family. To transport the pizza pies, it is more convenient to have the two or more pizza pies packaged within one pizza pie box. It is also more efficient for the pizza shop owner to provide a single foldable cardboard structure that folds into a multi-layered pizza pie box. The use of a multi-layered pizza pie box saves on storage space and cost.

Dual pizza pie boxes are known in the art. U.S. Pat. No. 5,002,221 issued to Ragan discloses one type of stacked pizza pie box. This prior art discloses a dual pizza pie box formed by a single perforated end cut flat cardboard structure. When folded, poke-in internal shelf supports are positioned at each corner of the box to support a second pizza pie on a shelf resting on the poke-in shelf supports. The prior art further discloses a separator stand for holding the shelf and the lid away from the enclosed pizza pies.

The present invention provides an improvement over the prior art. The separator stand disclosed in the prior art requires additional storage space at the pizza shop plus added cost of the pizza pie box.

SUMMARY OF THE INVENTION

The present inventor addresses the aforementioned concerns and provides a storable single cardboard sheet that is perforated and cut to provide a foldable pizza pie box having multiple layers. The invention further provides a multi-layered pizza pie box having a lid with flaps that correspond to shelf supports within the box that prevent the lid from crushing the upper pizza pie. The lid further includes tabs that extend over the vertical edges of the box to prevent the lid from being crushed inwardly. The pizza pie box of the present invention also provides structural means to provide strength and durability to the pizza pie box.

In another aspect of the invention, a foldable shelf is provided for positioning on the shelf supports and for receiving a pizza pie thereon.

In yet another aspect of the invention, the shelf supports may also be layered vertically to accept another foldable shelf thereon.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
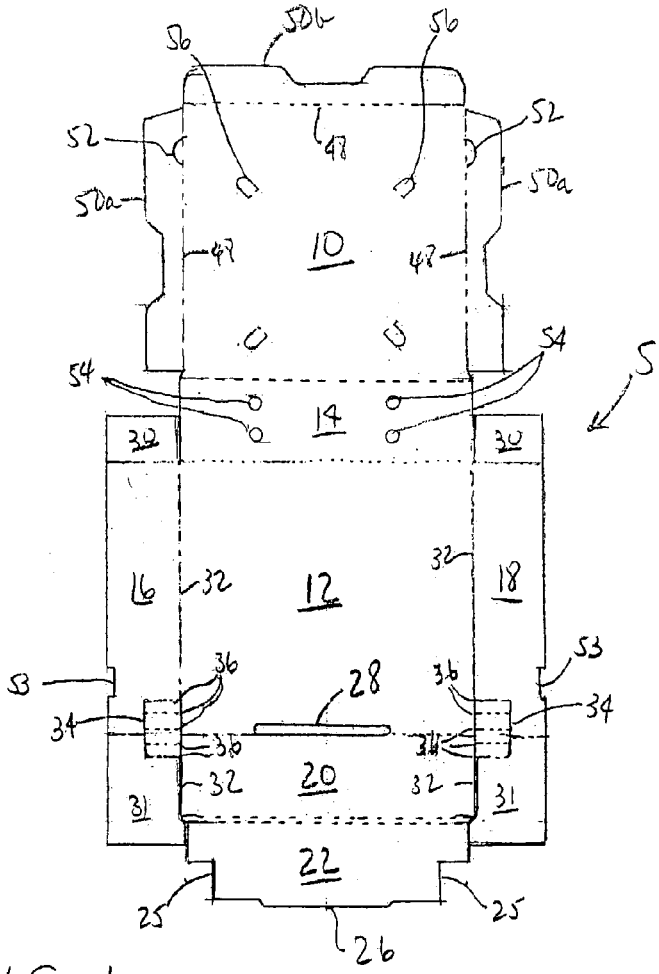
FIG. 1 shows an unfolded cardboard box scored and having cut-outs used to form the box of the present invention.
Figure 2:
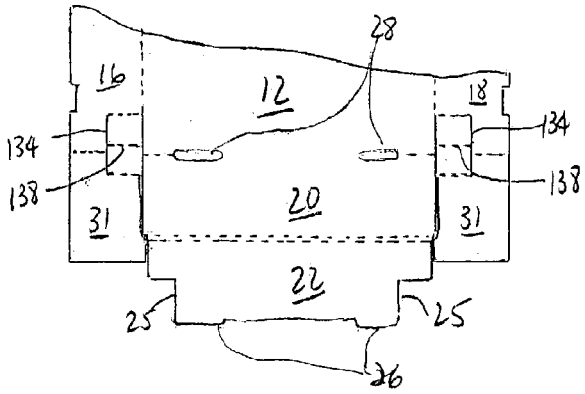
FIG. 2 shows a portion of another alternative embodiment of the unfolded cardboard type box having scores and cut-outs used to form another box of the present invention.

FIG. 1 shows a cardboard type box 5 in its unassembled configuration to illustrate the features of one of the illustrated embodiments. The solid lines indicate cut lines, and the dashed lines indicate perforated lines. The box is formed by a single sheet of heavy weight paper, such as cardboard that can be stored in a flat planar configuration and then folded into a box formation for use. The box 5 includes a lid 10 and a bottom floor 12. The lid 10 is hinged to the bottom floor 12 of the box 5 and separated by a vertical side wall 14. The remaining three vertical side walls are designated as 16, 18 and 20 respectively. Side wall 20 is reinforced by having a hinged flap 22 for doubling the side wall strength of the pizza box. Side wall 20 also has a tab 26 that is insertable into slot 28 at the base of side wall 20. Tab 26 forms a locking means to secure flap 22 to side wall 20. The tab 26 may be a single center tab 26 for positioning into center slot 28 as shown in FIG. 1. There may also be two tabs 26 with a pair of slots 28 as shown in FIG. 2. When flap 22 is folded over side wall 20, an envelope is formed between the two layers. Side walls 14, 16, and 18 remain single layered. Side walls 16 and 18 have extending flaps 30 and 31 extending from each end. Extending flap 31 is foldable within the envelopes formed by flap 22 and wall 20. This arrangement is shown more clearly in FIG. 3. Extending flaps 30 fold against the side wall 14 to help anchor the lid 10 when the lid is closed as will be discussed hereinafter.

Figure 3:
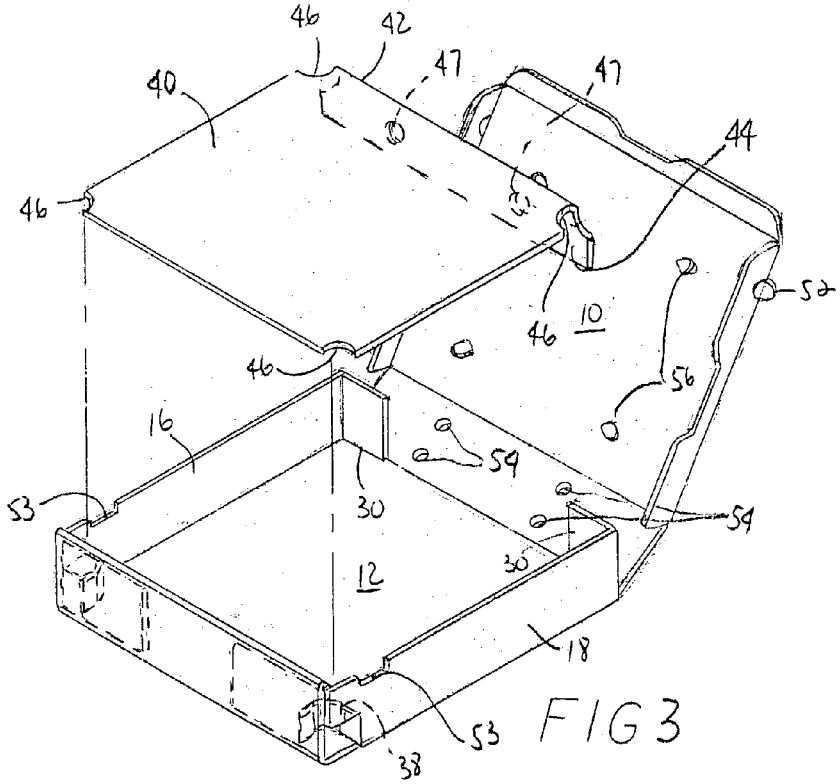
FIG. 3 is an exploded perspective view of the box of FIG. 1 assembled and showing the lid in the open position and a foldable shelf.
Figure 5:
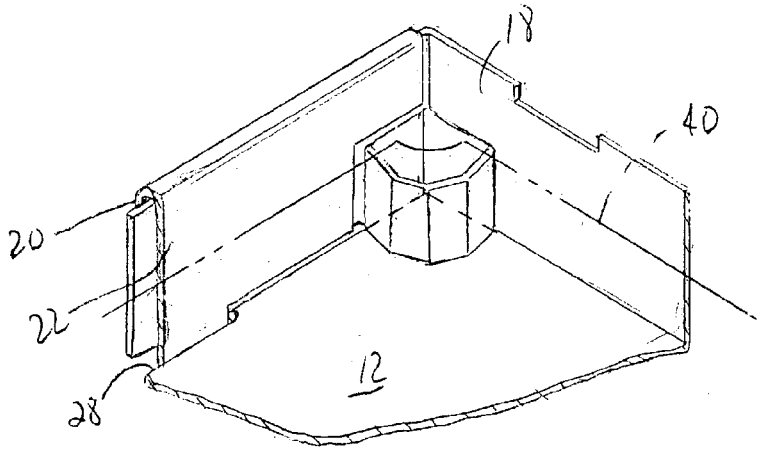
FIG. 5 is a sectional view of an inside corner of the box of FIG. 1 assembled.

In the first embodiment, at the corner fold line 32 separating the side floor and walls 16 and 18 and the side wall 20 with its respective extending flaps 31, there are located foldable support members formed by single slit and multiple fold lines 36 such that when folded a rounded or multi-sided corner support 38 is formed, as shown in FIGS. 3 and 5. The rounded corner supports 38 extend to approximately half the height of the side walls 16, 18, 20. Therefore, when the box is assembled as better shown in FIG. 3, the corner supports 38 provide a portion of the support half way the height of the box for a second large pizza pie for storing a second layer pizza pie. Rectangular notches 25 in the flap 22 provide space for the corner support 38 to extend into the interior of the box 5.

The other portion of the support for a second layer pizza pie is provided by a foldable shelf 40. The foldable shelf 40 has a rectangular shape with a perforated fold line 42 parallel and adjacent to one peripheral side of the shelf to form a side wall 44. The height of the side wall 44 formed on the foldable shelf 40 is the same or less than the height of the corner supports 38 so that the shelf 40 is level and essentially parallel with the floor 12 when positioned within the assembled box 5. Other features of the foldable shelf 40 includes corner notches 46. The corner notches 46 provide a cutout for receiving a portion of the corner support 38 if the height of the side wall 44 of the foldable shelf 40 is less than the height of the corner support 38. Further, the notches 46 provide vent holes for the lower level pizza pie. In addition, the notches 46, provide a gripping means for removing the shelf 40 from the interior of the box 5. In addition, the side wall 44 of the shelf may include other vent holes 47 therethrough.

Returning to the box 5 in FIG. 1, the lid 10 when folded along the perforated edges 48 includes two side downwardly extending flaps 50*a* and one front downwardly extending flap 50*b*. The downwardly extending flaps 50*a, b* of the lid 10 are configured and sized such that when the lid 10 is in its closed position, a portion of the extending flaps 50*a, b* meet the corner supports 38, which stop the further lowering of the lid 10. Therefore, the fold-out corner supports 38 serve a dual purpose of acting as a support for a second layer pizza pie as well as a stop in conjunction with the downwardly extending flaps 50*a, b* of the lid 10 to prevent the lid 10 from crushing the pizza pie. When the lid is closed, the front extending flap 50*b* is anchored between side walls 16 and 18. The two side extending flaps 50*a* are anchored between walls 20 and extending flaps 30.

In addition, when the lid 10 is folded for use, the lid 10 also includes a small cut-out tab 52 that extends horizontally outwardly from opposing sides of the lid 10. When the lid 10 is folded such that the downwardly extending flaps 50 are extending into the interior of the pizza box, the extending tabs 52 extend over the opposed side walls 16 and 18 to provide another stop means for the lid 10. A cutout 53 is provided along each outer peripheral edge of walls 16 and 18 for receiving the extending tabs 52 when the lid is closed. The small tabs 52 further act as a grip for lifting the lid 10 away from the side walls 16, 18, 20 such that the interior of the pizza box is exposed. Other features of this dual stacked pizza pie box includes vent holes 54 on at least one of the side walls and situated to vent both levels of pizza pies, as well as vent holes 56 in the lid 10 of the box 5. The vent holes 56 in the lid 10 also provide a gripping means for opening the lid 10.

Figure 4:
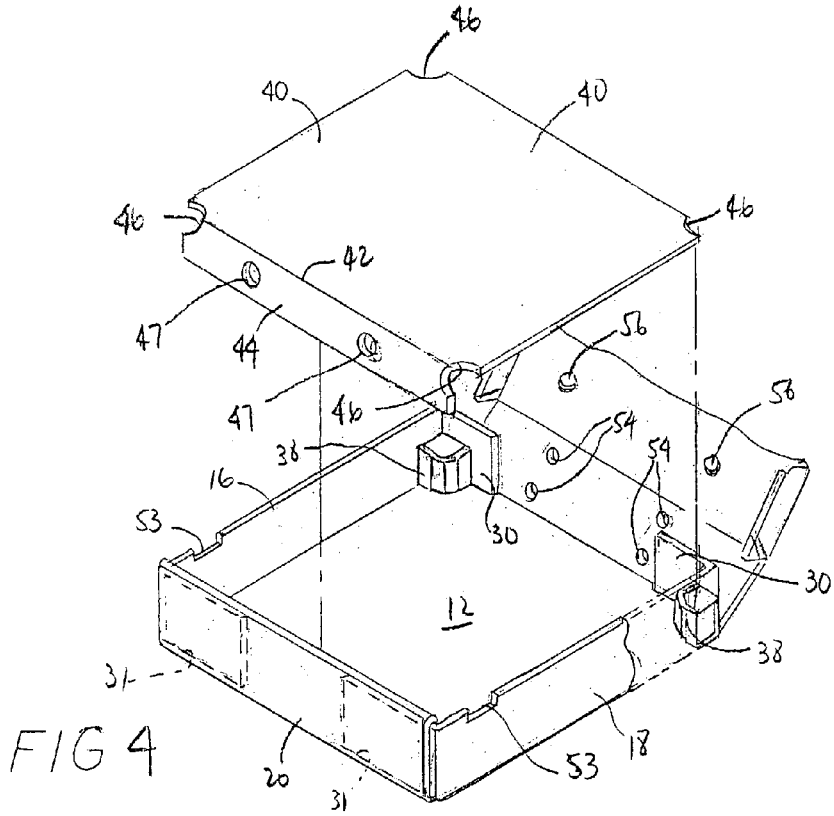
FIG. 4 is a portion of another embodiment of the assembled box and a foldable shelf shown in FIG. 3.

The box 5 in FIG. 1 is shown in FIG. 3 in its assembled mode. In FIGS. 1 and 3, the corner supports 38 are preferably positioned spaced from the side wall 14 which separates the lid 10 from the floor 12, because the corners formed by side walls 16, 20 and 18, 20 are structurally stronger than the corners formed by side walls 16 and flap 30, and side wall 18 and flap 30. In this configuration the foldable shelf 40 is placed inside the box 5 so that the side wall 44 of the shelf 40 is adjacent side wall 14 of the box 5. However, the box 5 can be configured so that the corner supports 38 are formed between the extending flap 30 and side wall 16 and the other extending flap 30 and side wall 18, as shown in FIG. 4. In this configuration the foldable shelf 40 is placed inside the box 5 so that the side wall 44 is adjacent flap 22.

Figure 7:
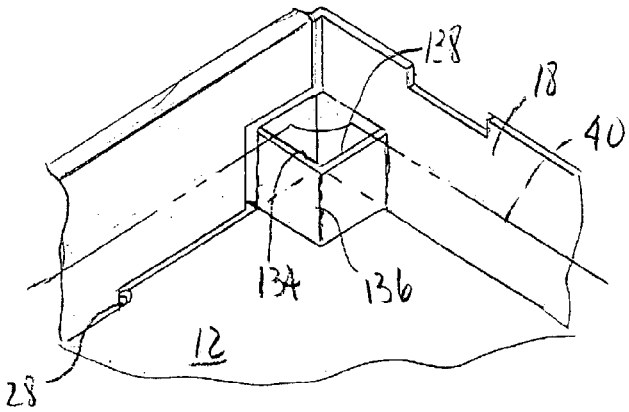
FIG. 7 is a sectional view of another embodiment of an inside corner to the box.

The second embodiment as shown in FIG. 7 is similar to the first embodiment except for the configuration of the fold-out corner support as designated by 138. The corner support 138 is located in only two adjacent corners of the assembled box 5. Each support shelf 138, is formed by a single slit 134 and a single fold line 136 such that when folded, a rectangular corner support 138 is formed. The rectangular corner support 138 of FIG. 7 is also positioned at a height to correspond with flap 50*a* to form a stop for the lid 10.

Figure 8:
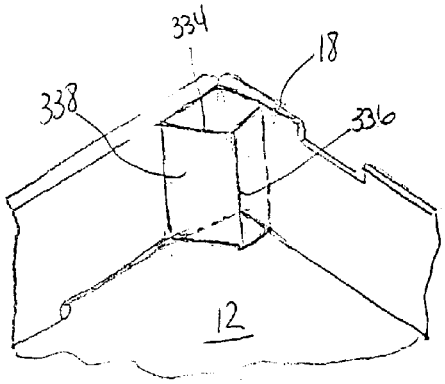
FIG. 8 is a sectional view of a third embodiment of an inside corner to the box.

The third embodiment, as shown in FIG. 8, is similar to the second embodiment except that the configuration of the fold-out corner support is a diamond shape. The diamond-shaped support shelf 338 is also formed by a single slit 334 and fold line 336 such that when folded, the diamond-shaped corner support 338 is formed.

Figure 9:
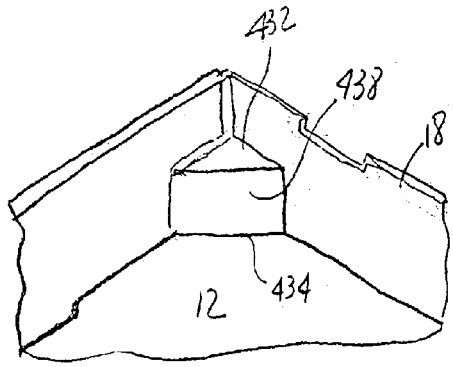
FIG. 9 is a sectional view of a fourth embodiment of an inside corner to the box.

The fourth embodiment for a corner support 438 is shown in FIG. 9. The shelf or corner support 438 is formed by triangular cut-outs 432 and triangular fold-outs 434. The triangular fold-outs 434 extend to approximately half the height of the side walls. These features are shown in the partial view of an unfolded box of FIG. 10. Although FIG. 10 shows only one side of the unfolded box, it is clear that the other side is a mirror image of the illustrated side.

Figure 10:
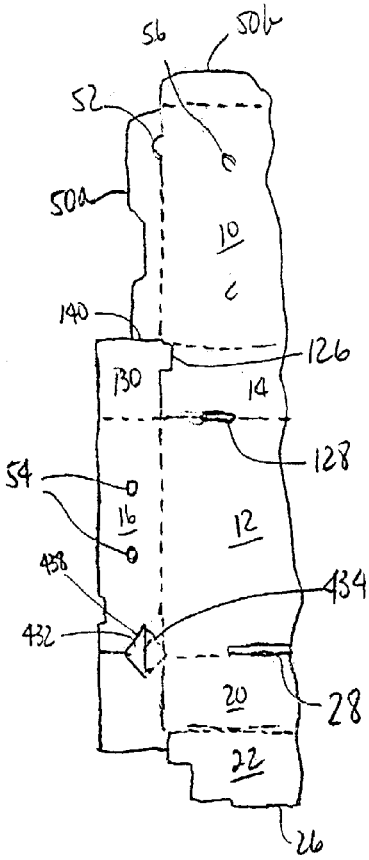
FIG. 10 is a portion of an unfolded cardboard box having scores and cutouts to provide the inside corner as shown in FIG. 9.

FIG. 10 illustrates other alternatives to the present invention. In particular, it is shown that the vent holes 54 can be placed on any of the side walls 14, 16, or 18. More importantly, the extending flap 130 is now extended to the extending flap 50*a* with a cut line 140 therebetween. The extending flap 130 has an inner tab 126 that is insertable into slot 128 located between the side wall 14 and the floor 12. The location of the inner tab 126 and slot 128 minimizes the effort required to close the lid 10 over the box. The inner tab 126 positioned within the slot 128 adds support to the side walls 16, 18, and 20 so that the side walls 16 and 18 do not have to be manually held when closing the lid 10.

Figure 6:
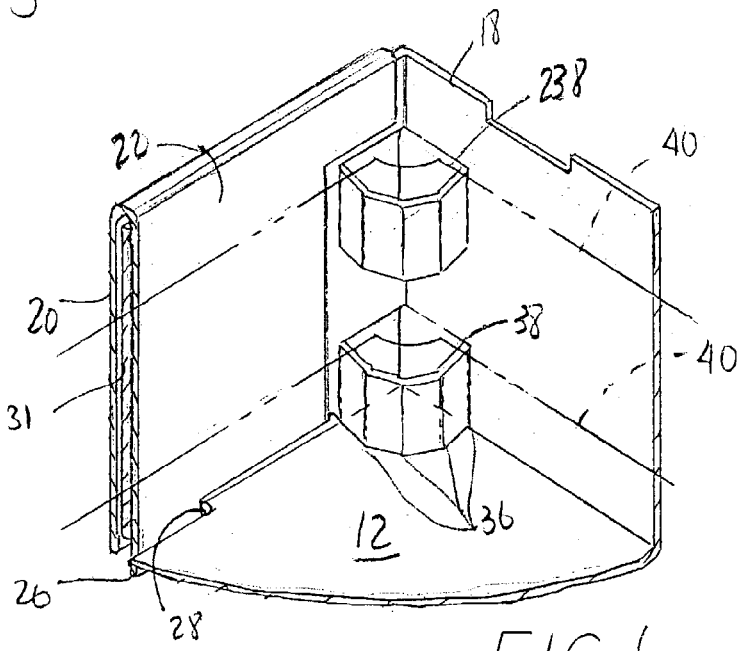
FIG. 6 is a sectional view of an inside corner of the box having shelf supports in the vertical direction.

FIG. 6 shows yet another embodiment, wherein the pizza pie box 5 can be made to hold three or more pizza pies for transport. FIG. 6 shows only a portion of the box in which the side walls 14, 16, 18 and 20 are made taller so that another pair of corner supports 238 (in either configuration) can be positioned over the first pair of corner supports 38. As an alternative, instead of placing the second pair of corner supports 238 over the first pair of corner supports 38, the second pair of corner supports 238 can be placed at their raised position in the two corners opposite the corners having the first pair of corner supports 38. Therefore, in this alternative there would be a corner support in each corner; however, each pair of corner supports are at different levels from each other.

This invention provides an advantage over the prior art in that less heavy weight material is required to configure into a box. Further, the box 5 and its associated foldable shelf 40 can be stored in a flat, planar configuration, when not in use, and then be easily folded into a usable box as required. Therefore, both the storage space and the assembly time are minimized.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An improved cardboard pizza box for transporting two or more pizza pies, said box having a rectangular floor, four side walls integrally connected to the floor and forming four corners and a lid integrally to one of the side walls and spaced from the floor, the improvement comprising:

two first integral shelf supports positioned adjacent the rectangular floor and positioned in adjacent corners of the floor, said two integral shelf supports each formed by perforated and cut portions of the adjacent corners for folding inwardly; and a rectangular foldable shelf having a single perforated fold line parallel and adjacent to one peripheral side of the shelf to form a side wall when said shelf folded along the perforated fold line, wherein said foldable shelf has a dimension for disposition into the pizza box with the side wall of the shelf disposed adjacent to one of the side walls of the pizza box and wherein the one peripheral side rests on the floor and a portion of the shelf opposing the perforated fold line rests on the pair of first integral shelf supports when the box is assembled.

2. The improved cardboard pizza box of claim 1, wherein the two integral shelf supports each form a rectangular support.

3. The improved cardboard pizza box of claim 1, wherein the two integral shelf supports each form a support having more than two sides.

4. The improved cardboard pizza box of claim 1, wherein a second pair of integral shelf supports are positioned at a predetermined space from the rectangular floor for receiving a second rectangular foldable shelf.

5. The improved cardboard pizza box of claim 4, wherein the second pair of integral shelf supports are positioned proximate to the two first integral shelf supports.

6. The improved cardboard box of claim 4, wherein the second pair of integral shelf supports are positioned in the other corners spaced from the adjacent corners having the two first integral shelf supports.

7. The improved cardboard box of claim 1, wherein the side wall of the box opposing the side wall integrally connected to the lid has an extension for folding over to form a dual layer wall.

8. The improved cardboard box of claim 7, wherein the side walls of the box adjacent to the dual layer wall have flaps for folding between the extension and corresponding side walls of the dual layer wall.

9. The improved cardboard box of claim 1, wherein the two first integral shelf supports form a diamond shape.

10. The improved cardboard box of claim 1, wherein the two first integral shelf supports form a triangular shape.

11. The improved cardboard box of claim 10, wherein the triangular shaped shelf support has a base orientated parallel to the side walls and perpendicular to the floor when the box is assembled.

12. The improved cardboard box of claim 1, wherein one of the side walls is adjacent to the lid when the box is in the unfolded position, and wherein the opposing side wall has extending flaps with inner tabs for disposition within slots disposed between the floor and the side wall which is adjacent to the lid.

13. The improved cardboard box of claim 1, wherein the side wall adjacent to the lid when the box is in the unfolded position has a slot between the floor and said side wall, and at least one of the adjacent side walls has an extending flap with an inner tab for disposition within the slot.

14. The improved cardboard box of claim 1, wherein the foldable shelf has corners opposing the fold line for disposition on the pair of first integral shelf support for providing a surface parallel to the floor within the box.

15. The improved cardboard box of claim 1, wherein the side wall opposing the side wall adjacent to the lid has a slot for receiving a peripheral tab to provide a double layer side wall.

16. The improved cardboard box of claim 1, further comprising horizontally extending cut-out tabs providing a gripping and stop means for the lid.

17. The improved cardboard pizza box of claim 1, wherein the height of the shelf supports are the same height of the side wall of the shelf.

* * * * *